US005431343A

United States Patent [19]

Kubiak et al.

[11] Patent Number: 5,431,343

[45] Date of Patent: Jul. 11, 1995

[54] FIBER JET NOZZLE FOR DISPENSING VISCOUS ADHESIVES

[75] Inventors: Jeffrey F. Kubiak, Cleveland; Herman E. Turner, Jr., Wellington, both of Ohio

[73] Assignee: Nordson Corporation, Westlake, Ohio

[21] Appl. No.: 213,845

[22] Filed: Mar. 15, 1994

[51] Int. Cl.[6] ..... B05B 1/34; B05B 7/06; B05B 7/10

[52] U.S. Cl. ..... 239/105; 239/405; 239/406; 239/424; 239/490

[58] Field of Search ..... 239/406, 424, 290, 105, 239/405, 403, 423, 8, 434.5, 433, 491, 490; 156/578

[56] References Cited

U.S. PATENT DOCUMENTS

| | | | |
|---|---|---|---|
| Re. 33,481 | 12/1990 | Ziecker et al. | 239/298 |
| 2,051,210 | 8/1936 | Gustafson . | |
| 2,101,175 | 12/1937 | Gustafsson . | |
| 3,245,622 | 4/1966 | McBride | 239/424 X |
| 3,296,015 | 1/1967 | Juvinall et al. | 239/290 X |
| 3,308,870 | 3/1967 | Rex, Jr. | 239/406 |
| 3,507,589 | 4/1970 | Keller | 239/424 X |
| 3,543,332 | 12/1970 | Wagner et al. . | |
| 3,954,361 | 5/1976 | Page | 425/72 |
| 4,171,096 | 10/1979 | Welsh et al. | 239/424 X |
| 4,221,558 | 9/1980 | Santisi | 239/406 X |
| 4,324,361 | 4/1982 | Moos et al. | 239/406 X |
| 4,335,677 | 6/1982 | Nagata et al. | 239/406 X |
| 4,595,143 | 6/1986 | Simmons et al. | 239/406 X |
| 4,891,249 | 1/1990 | McIntyre | 239/424 X |
| 4,907,741 | 3/1990 | McIntyre | 239/124 |
| 4,911,956 | 3/1990 | Gabryszewski et al. | 427/424 |
| 4,927,346 | 5/1990 | Kaiser et al. | 425/81.1 |
| 4,957,783 | 9/1990 | Gabryszewski | 239/296 X |
| 4,960,244 | 10/1990 | Maag et al. | 239/424 |
| 4,969,602 | 11/1990 | Scholl | 239/298 |
| 4,983,109 | 1/1991 | Miller et al. | 239/298 X |
| 4,987,854 | 1/1991 | Hall | 118/679 |
| 5,026,450 | 6/1991 | Cucuzza et al. | 156/244.11 |
| 5,065,943 | 11/1991 | Boger et al. | 239/298 |
| 5,114,752 | 5/1992 | Hall | 427/273 |
| 5,169,071 | 12/1992 | Boger et al. | 239/296 |
| 5,194,115 | 3/1993 | Ramspeck et al. | 239/298 X |
| 5,228,624 | 7/1993 | Mensink | 239/406 |
| 5,292,068 | 3/1994 | Raterman et al. | 239/406 X |
| 5,294,459 | 3/1994 | Hogan et al. | 427/96 |

FOREIGN PATENT DOCUMENTS

| | | | |
|---|---|---|---|
| 2924174 | 12/1980 | Germany | 239/424 |
| 3543469 | 6/1987 | Germany . | |
| 1151091 | 5/1969 | United Kingdom | 239/424 |

*Primary Examiner*—Andres Kashnikow
*Assistant Examiner*—Lesley D. Morris
*Attorney, Agent, or Firm*—Wood, Herron & Evans

[57] ABSTRACT

A nozzle for use with an adhesive spray apparatus includes a nozzle having an extended tip and an air cap having a diverging air passage terminating at an outlet concentric about the tip end. An adhesive outlet at the tip end is extended beyond the air outlet. Channels for swirling the air in the cap about the nozzle are provided in the cap around the nozzle. Highly viscous adhesives are sprayed in a uniform pattern without adhesive accumulation on the nozzle and disruption of pattern.

25 Claims, 1 Drawing Sheet

FIBER JET NOZZLE FOR DISPENSING VISCOUS ADHESIVES

FIELD OF THE INVENTION

This invention relates generally to apparatus and methods for dispensing liquid adhesives in a fibrous spray pattern, and more particularly, to a nozzle and cap for dispensing viscous adhesives in a smooth, wide fibrous pattern which does not result in accumulation of adhesive material on the nozzle cap and deterioration of the spray pattern.

BACKGROUND OF THE INVENTION

Hot melt liquid adhesives are used in a number of different applications throughout industry for adhering a material to an object or to another material. Such adhesives are generally dispensed by a gun apparatus through a nozzle onto the material. In some applications, it is sufficient to extrude a simple line or bead of adhesive on the material. However, in other particular applications, it is desirable to swirl or disturb the adhesive bead by engaging it with a flow of pressurized air from jets or other orifices, such that the air flow swirls or flings the adhesive around to create a wide adhesive pattern which comprises generally thin overlapped fibers or strands of adhesive.

Adhesive dispensing equipment for creating such spray patterns generally includes a dispensing gun apparatus and at least one gun nozzle which is coupled to a supply of liquid adhesive by an adhesive line and to a supply of pressurized air by an air line. In operation, hot melt adhesive flows through the adhesive line of the gun to the nozzle and is extruded from the nozzle as a bead of adhesive. Pressurized air is then directed from the end of the nozzle toward the bead of adhesive to disturb or move the adhesive bead or otherwise control how it is applied and sprayed on the surface of interest. A nozzle cap generally surrounding the nozzle has a particular shape and configuration which controls the air and its cooperation with the adhesive to achieve the desired spray pattern.

One way of applying a sprayed pattern of adhesive is to swirl the adhesive in controlled circles. In swirled adhesive spray patterns, the pressurized air directed toward the dispensed bead of adhesive is controlled to stretch or attenuate the bead into a thin fiber or strand and to precisely move the strand around in a generally circular pattern. The finished pattern of applied adhesive on the surface comprises numerous, overlapping circles of thin adhesive strands as opposed to a singular, thick bead of adhesive. One application for a swirl technique is the bonding of nonwoven fibrous material to a polyurethane substrate in articles such as disposable diapers, incontinence pads and other related articles. For example, U.S. Pat. Nos. 4,969,602; RE33481; 4,983,109; 5,026,450, 5,065,943, and 5,194,115 all owned by the assignee of the present application, disclose various apparatus and methods for applying hot melt thermoplastic adhesives in overlapping, circular swirls of adhesive.

In the automotive industry, solvent based adhesives have traditionally been used, for example, to join carpet to the interior portion of a door. However, in order to overcome some inherent limitations associated with such solvent based systems, the automotive industry is investigating other bonding systems, such as hot melt adhesives. Unfortunately, attempting to apply hot melt adhesives suitable for the automotive industry in a stable pattern is different than applying hot melt adhesives to diapers.

The typical adhesives utilized in automotive applications are generally thermo-setting, polyurethane adhesives which are particularly viscous, and therefore, have different spray properties than the various types of hot melt adhesives utilized in other adhesive dispensing applications, such as those used in the disposable diaper industry. Therefore, while the nozzles utilized to dispense hot melt adhesives for other industries may be adequately suited for those particular applications, they may not be particularly suited for applying thermo-setting polyurethane adhesives in a fibrous spray pattern for automotive applications.

Specifically, it has been found that spray patterns of viscous polyurethane adhesive generated through some existing nozzle and cap assemblies did not produce a suitable stable pattern. For example, the pattern of adhesive tended to shift during spraying, and the spray pattern did not remain consistent from day to day. Additionally, it was difficult and sometimes impossible to achieve a suitably wide adhesive pattern.

Furthermore, with at least one currently existing nozzle assembly, fibers of the sprayed adhesive material had a tendency to swing up from the spray pattern and hit the nozzle, sticking to the nozzle and blocking the flow of pressurized air utilized to control the spray pattern. Apparently, the elasticity of the polyurethane adhesives is higher than with traditional hot melt adhesives. The accumulation of fibers on the nozzle is particularly undesirable because one fiber extending across the air flow tends to cause other fibers to accumulate on the nozzle thereby deteriorating and sometimes destroying the spray pattern altogether, thus rendering the nozzle inoperable.

Accordingly, it is an objective of the present invention to provide a nozzle assembly which produces a stable spray pattern when used with polyurethane adhesives and which consistently retains its defined shape and dimensions.

It is a further objective of the invention to produce a spray pattern that is sufficiently wide to be practical for use in various applications, and particularly automotive applications.

It is a further objective of the present invention to provide a nozzle which prevents fibers or strands of adhesive material from contacting and sticking to the nozzle assembly and thereby prevents shifting or complete destruction of the spray pattern.

SUMMARY OF THE INVENTION

The present invention addresses these and other objectives by presenting a fiber jet nozzle for attachment to the end of a dispensing module or gun and which produces consistent, wide patterns and prevents adhesive fibers from attaching themselves to the nozzle assembly even when used to dispense viscous, thermosetting polyurethane adhesives. Specifically, the fiber jet nozzle of the present invention comprises a fluid tip with an adhesive bore formed therein which is seated within an air cap having an air passage formed therein. The fluid tip extends generally coaxially within the air cap and through the air passage such that the air cap surrounds the nozzle tip and the air passage concentrically surrounds the adhesive bore. The bore is separated from the air passage such that no mixing of the adhesive and pressurized air takes place in the air cap.

When the nozzle is attached to the end of a gun, the fluid tip is coupled to a supply line of adhesive such that adhesive may be dispensed through the bore and out of a fluid outlet at the end of the tip, while the air cap serves to couple the air passage to a supply of pressurized air in the gun to control the spray pattern of the dispensed adhesive. The outlet end of the air passage includes an extension section which flares conically outwardly to define a flared air passage outlet end and an air outlet. The flared air passage outlet end directs the turbulent air created by the air passage so that it impinges upon the dispensed adhesive bead and creates a sufficiently wide spray pattern. This results in a substantial savings of time and uniform application of adhesive to the surface of interest. For example, this allows for thin substrates to be bound together, such as in the laminating of door panels, without the adhesive reading through.

The nozzle tip extends down through the center of the air passage beyond the flared air passage outlet end and beyond the air passage outlet. Therefore, the fluid outlet of the adhesive bore is beyond the air passage outlet and the bead of adhesive is dispensed from the adhesive bore below the air outlet. In a preferred embodiment, the length of the adhesive bore in the tip is approximately ten (10) times or more greater than the inner diameter of the tip bore. The combination of the extended bore, which has a fluid outlet extending beyond the air passage outlet, and a flared air passage outlet end creates a wide pattern of adhesive spray which is smooth, stable and consistent. The location of the adhesive bore outlet beyond the air passage outlet prevents stray fibers and strands from the adhesive spray pattern from attaching to the nozzle cap and shifting or completely destroying the spray pattern.

The air passage extension and, particularly, the flared outlet end extends beyond the outermost face surface of the nozzle cap and beyond the body of the nozzle cap. Therefore, the outlet of the air passage is spaced beyond the nozzle cap. This extension of the air passage away from the nozzle cap body further prevents stray adhesive fibers from attaching to the nozzle cap and hanging across the air flow.

The flow of air through the air passage of the air cap is diverted by angled channels formed in an inner wall of the air cap. Specifically, a seat section of the air cap has an inner diameter approximately the same as the outer diameter of a seating portion of the fluid nozzle. A seating portion of the nozzle sits within the seat section of the air cap when the nozzle cap is assembled. Vertical channels are formed within an annular wall defining the seat section of the air cap, and adjacent the nozzle. The channels provide a plurality of angled air passages around the nozzle seating portion to achieve the continuous air passage. The angled channels direct the pressurized air to strike a generally horizontal shelf whereupon a turbulent flow of air is created to pass through the flared extension section of the air passage. Preferably, all of the channels are angled in the same direction and are angled at 20° from the vertical direction to create a generally circular turbulent flow of air around the air passage.

The nozzle of the present invention creates a generally fibrous web spray pattern consisting of a large number of thin, overlapping and randomly-oriented adhesive fibers when used with adhesives of a particular viscosity, while creating a generally splatter-type pattern of interconnected adhesive droplets and fibers when used with less viscous adhesives.

Therefore, the nozzle cap of the present invention provides a smooth, stable and consistent flow pattern and particularly provides a stable, consistent pattern with highly viscous and elastic polyurethane adhesives. The nozzle provides a wide and usable spray pattern and prevents stray adhesive fibers from attaching to the air cap and accumulating to shift and destroy the spray pattern. These and other advantages will become more readily apparent from the following detailed description of a preferred embodiment and from the description of the drawings below.

DETAILED DESCRIPTION OF THE INVENTION

Figure 1:
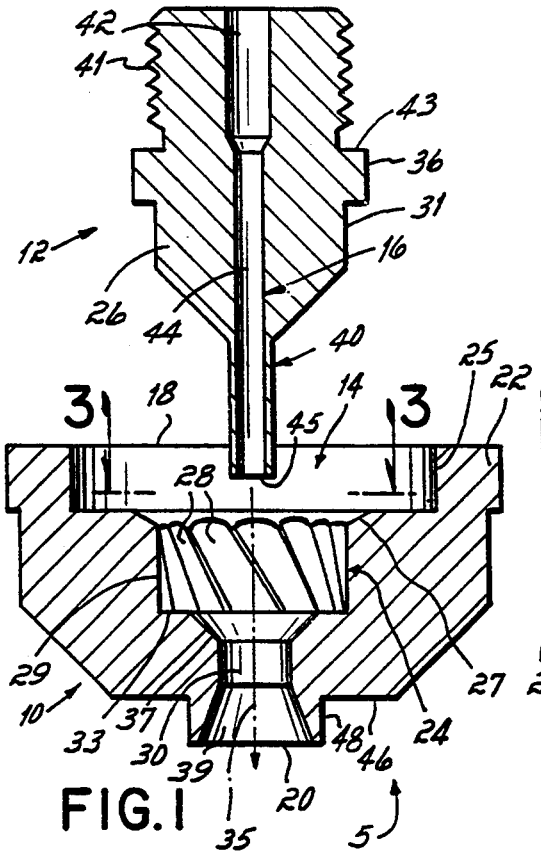
FIG. 1 is a disassembled cross-sectional view of the nozzle and air cap of the present invention.
Figure 2:
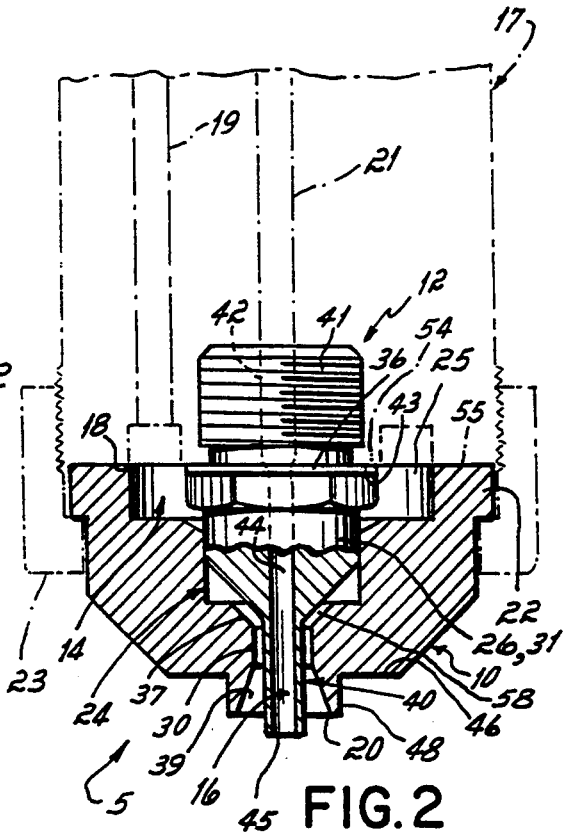
FIG. 2 is an assembled view of the nozzle and air cap.

Referring to FIG. 1, the nozzle assembly 5 of the present invention includes an air cap 10 and an adhesive nozzle 12 which is seated within air cap 10 to form the complete nozzle assembly 5 as seen in FIG. 2. Air cap 10 and adhesive nozzle 12 have generally circular cross-sections of varying diameters over the lengths of the cap 10 and nozzle 12, and air cap 10 extends concentrically around adhesive nozzle 12 when the nozzle 12 is seated therein. A continuous air passage 14 is formed within air cap 10 through the entire length of the cap 10 while an elongated fluid bore 16 extends generally through the center of adhesive nozzle 12 and through the entire length of the nozzle tip 40.

When nozzle 12 is seated within air cap 10, the fluid bore 16 extends coaxially within air passage 14, and air passage 14 concentrically surrounds bore 16.

As seen in FIG. 2, nozzle assembly 5 is configured to be fitted to the end of an adhesive spray gun 17, shown in phantom, such that the air passage 14 and fluid bore 16, are coupled to a pressurized air line 19 and fluid adhesive supply line 21, respectively, in gun 17.

A suitable spray gun for using the nozzle 5 of the present invention with is the Meltex EP 3450 available from Nordson Corporation of Amherst, Ohio.

The nozzle 12 has a threaded section 41 which is screwed into the gun 17 to a depth defined by the rear surface 43 of the annular hexagonal collar 36 of the fluid nozzle 12. The cap 10 is held around the nozzle by a retaining ring 23, shown in phantom in FIG. 2. In operation, a bead of adhesive is dispensed through bore 16 of nozzle 12 while pressurized air passes through air passage 14 to impinge upon the bead of adhesive. The air swirls and stretches the adhesive bead to form thin fibers of adhesive and create a spray pattern for depositing adhesive onto a material or surface of interest (not shown).

Referring to FIG. 1, air passage 14 has an inlet end 18 and an outlet end which defines an air outlet 20. Air passage 14 starts at a relatively large diameter at inlet end 18 and is reduced down to a smaller diameter at outlet end 20. A first diameter air introduction section 25 is formed in the cap 10 along with an outer annular flange 22 which is gripped by ring 23. Air introduction section 25 is mounted to gun 17 so that air in line 19 is coupled to passage 14. The shape and dimensions of section 25 and annular flange 22 might be modified depending upon the gun configuration.

Section 25 tapers through a sloped wall 27 to a nozzle seat section 24 formed by a generally vertical (as oriented in FIG. 1) annular wall 29. Nozzle receiving or seat section 24 receives a seating portion 26 of the nozzle 12 to hold the nozzle as shown in FIG. 2 and described further hereinbelow.

The outer diameter of the seating portion 26, defined by surface 31, on the adhesive nozzle 12 is approximately the same as inner diameter dimension of seat section 24. Therefore, when adhesive nozzle 12 is seated within air cap 10, there is a relatively secure fit between the cap 10 and nozzle 12 to generally center the adhesive bore 16 within the air passage 14 of the cap. This ensures a uniform flow of pressurized air around the dispensed bead of adhesive when the gun is operating.

Figure 3:
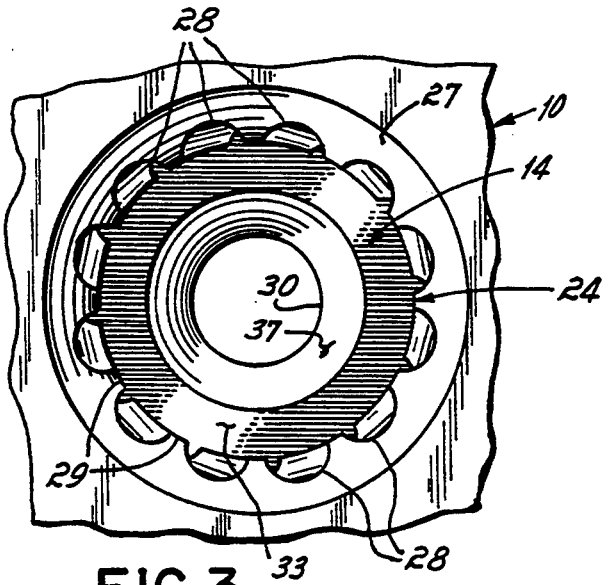
FIG. 3 is a top view of the air cap structure showing the channeled seat of the air cap; as seen along line 3—3 of FIG. 1.

As illustrated in FIG. 2, if the annular wall 29 of seat section 24 and the outer surface 31 of nozzle seating portion 26 are smooth, the seating portion 26 would fit somewhat snugly within the nozzle seat section 24 and would essentially seal air passage 14, blocking air from passing the seat section 24 and being blown out the air passage outlet 20. In the cap of the present invention, however, a plurality of angled channels 28 (FIG. 3) preferably of equal dimensions are formed completely around the annular wall 29. The channels 28 open up air passages between inner wall 29 and outer surface 31 of seating portion 26 such that pressurized air may pass around seating portion 26 of the adhesive nozzle 12 and travel out the outlet end 20 of air passage 14 (see FIG. 3).

At the bottom of seat section 24, the air channels 28 terminate at a flat, generally horizontal wall 33. The flow of air striking wall 33 creates air turbulence within air passage 14, so that a turbulent flow of air travels out of the outlet 20 of passage 14 to impinge upon a dispensed bead of adhesive from adhesive bore 16 to create a spray pattern. The angled channels 28 are preferably all angled in the same direction and are at the same angular orientation such that they extend generally parallel with one another. This configuration creates a predominantly circular flow of turbulent air around and through the dispensed bead of adhesive. The angled channels 28 are angled in a range of 5° to 50° from the vertical direction defined by vertical reference line 35, and preferably are angled at an angle of 20°.

Below the seat section 24 and angled channels 28, the air passage 14 converges inwardly to a smaller diameter through sloped wall 37. Air passage 14 then is defined by a straight section 30 which maintains the smaller diameter established by sloped wall 37. Straight section 30 operates to somewhat straighten the flow of the turbulent air coming from seat region 24 and off of sloped wall 37.

Straight section 30 is followed by the outlet end 20 of air passage 14. The outlet end 20 flares outwardly in diameter and is defined by wall surface 39 which slopes outwardly from the straight section 30 to air passage outlet 20. Flared outlet end 20 operates to spread the flow of the turbulent air within air passage 14 such that when the air flow impinges upon a dispensed bead of adhesive, the developed spray pattern consisting of thin fibers and/or droplets of adhesive material is sufficiently wide to be of practical use in the desired adhesive applications.

Flared outlet end 20, when used with viscous polyurethane adhesive, produces a smooth and consistent spray pattern swath which is wide enough for general applications and is particularly useful for automotive applications using polyurethane adhesives such as to adhere a door panel to the inside surface of a car door. The sloped wall 39 defining the interior of flared outlet end 20 is generally angled in a range of 5° to 85°, and the wall 39 is preferably angled at 20° from the vertical direction 35 to produce a smooth and consistent spray pattern with a useful pattern width. In one embodiment, with wall 39 angled at 20°, the flared outlet end 20 increases the diameter of air passage 14 to about 1.6 times that of the straight section 30.

Depending upon parameters such as the air pressure of the air flow through passage 14 and the viscosity and temperature of the dispensed adhesive, the width of the spray pattern will vary. Accordingly, the angular flare of outlet end 20 may be adjusted to achieve a desirable width to the spray pattern.

Bore 16 is an elongated cylindrical bore having a wider inlet section 42 which is reduced down to a thinner elongated outlet section 44, which preferably has a length in the range of 0.2–1.0 inches long. The outlet section 44 of bore 16 extends through the length of tip 40 and is operable to straighten the flow of the adhesive as it travels through bore 16 to be dispensed from the outlet 45 of tip 40.

The inner diameter of the adhesive bore along straight section outlet 44 is preferably in the range of 0.02 to 0.10 inches and more preferably, is approximately 0.05 inches. The length and inner diameter of bore outlet section 44 is preferably dimensioned such that the length to diameter ratio (L/D) is approximately 10 or greater. The L/D ratio of 10 or greater in the adhesive bore 16, in cooperation with the structure of the present nozzle, creates a smooth and consistent spray pattern with a usable width when dispensing adhesives, and particularly when dispensing viscous polyurethane adhesives.

With reference to FIG. 2, to assemble the completed nozzle assembly 5, the threaded section 41 of nozzle 12 is screwed into gun 17 until the top surface 43 of collar 36 is flat against bottom surface 54 of the gun 17. Next, air cap 10 is placed over nozzle 12 such that the seat section 24 of air cap 10 fits over the seating portion 26 of the nozzle 12. The air cap 10 is held on a surface 55 of the gun 17 by retaining ring 23, secured thereon around annular shoulder 22 of air cap 10. The air cap 10 and nozzle 12 are configured such that when assembled, a continuous air passage 14 extends through the cap 10.

As seen in FIG. 2, when the nozzle is assembled, the seating portion 26 of nozzle 12 does not completely seat within seat section 24 of air cap 10 due to the standoff spacing created by collar 22 of the air cap 10. Therefore, air cap 10 is offset slightly from the nozzle 12 such that an air passage 58 is formed around nozzle 12 to complete air passage 14 from the inlet end 18 of cap 10 to the air passage outlet end 20.

In the assembled position, the outlet 45 of the tip 40 extends beyond the air outlet 20. While the distance from the adhesive outlet 45 to the air outlet 20 may vary, it is believed that the preferred distance is in the range of 0.02 to 0.10 inches.

Cap 10 has a flat dispensing face surface 46 which circles the outlet end 20 of air passage 14 and the outlet end 45 of the adhesive bore 16. The flared end 20 of air passage 14 is partially formed by an extension step 48 which extends beyond the face or surface 46 of cap 10. The extension step spaces the outlet 20 of the air passage 14 away from surface 46 and the body of cap 10. The length of extension step 48 is generally in a range of 0.05 to 0.30 inches and in a preferred embodiment is approximately 0.09 inches.

The spacing of the air passage outlet 20 from the nozzle cap body 10 and surface 46 produced by extension step 48 further ensures that the various fibers and strands of adhesive making up the spray pattern do not fling back and stick to face surface 46 or any other portion of nozzle cap 10. Therefore, the extension step 48 maintains the spray pattern away from air cap 10 such that stray adhesive fibers and strands do not gather across the outlet 20 of the air passage 14 and accumulate on the cap 10 to shift the spray pattern or completely block air passage outlet 20 and destroy the spray pattern. Therefore, the nozzle assembly 5 of the present invention achieves a smooth spray pattern which is consistently delivered to a surface of interest.

To further produce a smooth, consistent spray pattern and prevent blockage caused by stray adhesive fibers, the nozzle tip 40 of nozzle 12 is dimensioned to extend beyond the outlet 20 of the air passage 14. Specifically, as shown in FIG. 2, when the nozzle 12 and air cap 10 are completely assembled into a nozzle 5, the outlet 45 of adhesive bore 16 is spaced away from the outlet 20 of air passage 14. The dispensed adhesive is thus located away from air passage outlet 20 and away from the face surface 46 and the body of air cap 10.

Furthermore, the combination of a flared air passage section defined by sloped wall 39 and the nozzle tip 40 which extends beyond the air passage outlet 20 produces a spray pattern which is wide enough for practical applications. As may be appreciated, too narrow of an adhesive spray pattern would be somewhat analogous to applying adhesive causing bleed through and unsightly bulges in the adhered materials as well as increased spray time to cover the necessary areas.

The nozzle assembly 5 is particularly useful for applying thermo-setting, air-cured polyurethane adhesives having a viscosity in the range of 15,000 to 30,000 centipoise in a temperature range between 250° and 325° F. For example, thermo-setting, polyurethane adhesive number 98-15 available from Bostik Incorporated of Troy, Mich. has been utilized in automotive adhesive applications. The 98-15 adhesive was utilized with a nozzle assembly according to the present invention had a viscosity of approximately 22,000 centipoise at 284° F. The 98-15 adhesive dispensed through the nozzle of the present invention provided a useful, wide fibrous web pattern of adhesive containing a plurality of small, thin adhesive strands or fibers which were generally randomly-oriented with respect to each other but formed a predominantly circular pattern on the sprayed surface due to the predominantly circular motion of the pressurized air caused by angled channels 28. The pattern was approximately three inches wide when sprayed according to the parameters below:

Bostik 98-15 Adhesive
Flow Rate of Adhesive=6 grams/ft$^2$
Adhesive temperature=300° F.
Air pressure=40 PSI.
Air temperature=300° F.
Height of nozzle cap from sprayed surface=approximately 6 inches.

Another polyurethane adhesive useful in automotive applications produced a suitable spray pattern in the form of a splatter pattern of overlapping fibers and droplets of adhesive as opposed to the multi-strand or fibrous web pattern produced with adhesive 98-15. Specifically, Bostik polyurethane adhesive 97-12, having a viscosity of 16,000 centipoise at 284° F., was applied according to the parameters below and yielded a generally splatter-type pattern to the sprayed surface.

Bostik 97-12 Adhesive
Flow Rate of Adhesive=20 grams/ft.$^2$.
Adhesive temperature=300° F.
Air pressure=55 PSI.
Air temperature=350° F.
Height of nozzle cap from sprayed surface=approximately 9 inches.

In each of the above examples the adhesive was dispensed from a nozzle assembly wherein:

the length of the nozzle 12 was approximately 0.876 inches;
the length of the air cap was approximately 0.560 inches;
the inner diameter of section 25 was approximately 0.689 inches;
the inner diameter of section 24 was approximately 0.354 inches;
the inner diameter of section 30 was approximately 0.135 inches;
the length of section 44 was approximately 0.612 inches;
the inner diameter of the outlet 20 was approximately 0.213 inches; and
the distance between outlets 20 and 45 was approximately 0.05 inches.

As may be appreciated, other adhesives will yield suitable spray patterns either in the form of a fibrous web pattern or a splatter-type pattern depending upon the operating parameters of the spray gun and the viscosity and temperature of the adhesive.

While the present invention has been illustrated by the description of embodiments thereof, and while the embodiments have been described in considerable detail, it is not the intention of Applicants to restrict or in any way limit the scope of the appended claims to such detail. For example, the length of both the air passage extension and nozzle tip might be increased to further prevent adhesive accumulation on the nozzle cap. Further, the L/D ratio of the fluid bore in the nozzle might be adjusted to achieve a particular spray pattern in accordance with the principles of the present invention. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of Applicants' claims.

What is claimed is:

1. A nozzle assembly for dispensing viscous adhesives, said nozzle apparatus comprising:

a nozzle member having a seating portion and an elongated tip with an adhesive bore therein terminating at an adhesive outlet; and an air cap for surrounding said nozzle member and having an air passage therethrough diverging outwardly to an air outlet, the air passage defining in part a seat section to receive said seating portion such that said adhesive bore and said air passage are concentrically oriented with respect to each other;

said adhesive outlet extending beyond said air outlet when said nozzle member and cap are operatively seated together for dispensing adhesives.

2. Apparatus as in claim 1, wherein the air passage seat section and nozzle seating portion being dimensioned to create when assembled an air gap between the nozzle and air cap such that air may pass around said elongated tip and through the air passage.

3. Apparatus as in claim 1, wherein the air passage of the air cap includes an annular wall defining said seat section, said wall defining a plurality of channels to create air gaps between the wall and said nozzle seating portion such that air may pass around said seating portion while travelling through the air passage.

4. Apparatus as in claim 1, the adhesive bore including a generally straight section having a length and inner diameter, the length of said bore straight section being at least ten times greater than said inner diameter.

5. Apparatus as in claim 1, wherein said air passage includes an axis and an interior surface diverging outwardly around said axis to said air outlet at an angle in a range of 5° to 85° with respect to said axis.

6. Apparatus as in claim 5, wherein said angle is about 20°.

7. Apparatus as in claim 1, wherein said adhesive bore has an inner diameter in a range of 0.02 to 0.10 inches.

8. Apparatus as in claim 1, wherein said adhesive bore has an inner diameter of approximately 0.05 inches.

9. Apparatus as in claim 1, wherein said adhesive bore has a generally straight section extending to said adhesive outlet, the length of said straight section being in a range of 0.20 to 1.0 inches.

10. Apparatus as in claim 1, wherein said adhesive bore extends beyond said air outlet by a distance in a range of 0.02 to 0.10 inches.

11. Apparatus as in claim 1, wherein said air cap has an end face and includes an air outlet extension extending beyond said end face by a distance in the range of 0.05 to 0.30 inches.

12. Apparatus as in claim 10, wherein said air cap has an end face and includes an air outlet extension extending beyond said end face by a distance in the range of 0.05 to 0.30 inches.

13. Apparatus as in claim 3, said channels being oriented at an angle in said wall for swirling air when it passes through said air passage.

14. Apparatus as in claim 13, wherein said channels are inclined in said wall in a range of 20° to 40°.

15. Apparatus as in claim 3, wherein said seat section of said cap includes a flat shelf defining a terminus end for said channels, and further wherein said air passage includes a converging bore extending from said shelf toward said air outlet.

16. Apparatus as in claim 15, wherein said air passage further includes a cylindrical bore extending from said converging bore to said outwardly diverging air passage at said air outlet.

17. Apparatus as in claim 1, wherein said nozzle and said air cap are adapted for operative mounting on a gun independently of each other with said nozzle cooperating with said air cap to define in part said air passage between said nozzle and said air cap.

18. Apparatus as in claim 16, wherein said cylindrical bore has an inner diameter and said air outlet has an inner diameter which is about 1.6 times the inner diameter of said cylindrical bore.

19. Apparatus as in claim 12, wherein said air passage includes an axis and an interior surface diverging outwardly around said axis to said air outlet at an angle in a range of 5° to 85° with respect to said axis.

20. A method of dispensing a spray pattern of viscous fluid adhesive from a nozzle having an elongated adhesive bore and an air passage defined in an air cap about said bore, the method comprising:

directing pressurized air into said air passage such that air flows therethrough and is disturbed to produce a turbulent air flow, the air passage defining in part a seat section;

directing the turbulent flow of air through a flared outlet section of the air passage; and directing adhesive through said adhesive bore and an outlet at the end of the bore at a position located downstream of said air outlet, a portion of the nozzle defining a seating portion around the bore which is configured to be received by said seat section such that said adhesive bore and said air passage are concentrically oriented with respect to each other when the air and adhesive are directed through said passage and said bore, respectively;

air from said outlet engaging said dispensed adhesive;

whereby a uniform spray pattern of adhesive is produced without collection of adhesive on said air cap.

21. The method of claim 20 further comprising the step of directing the pressurized air through a plurality of inclined channels in said air cap around said nozzle to produce a generally swirling turbulent flow of air.

22. The method of claim 20 further comprising the step of directing the adhesive through said bore having a generally straight section with a length at least 10 times greater than the diameter of the bore.

23. A nozzle assembly for dispensing viscous adhesives, said nozzle assembly comprising:

a nozzle member having a seating portion and an elongated tip with an adhesive bore therein terminating at an adhesive outlet; and an air cap for surrounding said nozzle member and having an air passage therethrough, the air passage defining in part a seat section to receive said seating portion such that said adhesive bore and said air passage are concentrically oriented with respect to each other, said cap including a body portion which defines an endmost face surface of the nozzle assembly, the air passage including an air outlet extension which extends from said endmost face surface and terminates in an air outlet spaced from said endmost face surface, the air passage diverging outwardly to said air outlet;

said adhesive outlet extending beyond said air outlet when said nozzle member and cap are operatively mounted together for dispensing adhesives;

whereby the extended air and adhesive outlets prevent dispensed viscous adhesives from sticking to the face surface and the nozzle assembly.

24. Apparatus as in claim 23, the adhesive bore including a generally straight section having a length and inner diameter, the length of said bore straight section being at least 10 times greater than said inner diameter.

25. Apparatus as in claim 23, wherein said air passage includes an axis and an interior surface diverging outwardly around said axis to said air outlet at an angle in a range of 5° to 85° with respect to said axis.

* * * * *